US009551345B2

(12) United States Patent
Yanagisawa

(10) Patent No.: US 9,551,345 B2
(45) Date of Patent: Jan. 24, 2017

(54) AXIAL FLOW FAN

(71) Applicant: SANYO DENKI CO., LTD., Tokyo (JP)

(72) Inventor: Atsushi Yanagisawa, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 485 days.

(21) Appl. No.: 14/019,027

(22) Filed: Sep. 5, 2013

(65) Prior Publication Data

US 2014/0064959 A1 Mar. 6, 2014

(30) Foreign Application Priority Data

Sep. 6, 2012 (JP) ..... 2012-196327

(51) Int. Cl.

| | |
|---|---|
| ***F04D 19/00*** | (2006.01) |
| ***F04D 29/38*** | (2006.01) |
| ***F04D 29/54*** | (2006.01) |
| ***F04D 29/66*** | (2006.01) |

(52) U.S. Cl.

CPC ..... *F04D 19/002* (2013.01); *F04D 29/386* (2013.01); *F04D 29/547* (2013.01); *F04D 29/667* (2013.01)

(58) Field of Classification Search

CPC .... F04D 29/386; F04D 29/547; F04D 29/181; F04D 29/168; F04D 29/663; F04D 19/0024; F04D 19/002

See application file for complete search history.

(56) References Cited

U.S. PATENT DOCUMENTS

| | | | | |
|---|---|---|---|---|
| 2008/0101964 | A1 | 5/2008 | Iwase et al. | |
| 2010/0086405 | A1 * | 4/2010 | Higo | F04D 29/325 416/189 |

FOREIGN PATENT DOCUMENTS

| | | | |
|---|---|---|---|
| CN | 101713417 | B | 6/2012 |
| JP | 05133398 | A2 | 5/1993 |
| JP | H06-004399 | U | 1/1994 |
| JP | H07-167095 | A | 7/1995 |
| JP | 2005307793 | A | 11/2005 |
| JP | 2008111383 | A | 5/2008 |
| JP | 5133398 | B2 | 1/2013 |

OTHER PUBLICATIONS

Japanese Office Action mailed on Dec. 22, 2015 for the corresponding Japanese Patent Application No. 2012-196327.

Office Action dated Oct. 31, 2016 issued in the corresponding Taiwanese Patent Application No. 102131833, pp. 1-7.

European Search Report dated Sep. 27, 2016 from European Patent Application No. 13182893.1, pp. 1-9.

* cited by examiner

*Primary Examiner* — Gregory Anderson
*Assistant Examiner* — Maxime Adjagbe
(74) *Attorney, Agent, or Firm* — Polsinelli PC

(57) ABSTRACT

A leading edge of a rotating blade of an impeller is formed in an arc recessed in a direction opposite to a rotating direction of the impeller. An angle where an extended line of the recessed arc of the leading edge meets another extended line of a curve of a side edge is set in an acute angle of 30 to 37 degrees in a front view so that a leading tip of the rotating blade may be projected in the rotating direction. An opening angle of a suction-side slant portion of a venturi casing is set in the range of 12 to 17 degrees and an opening angle of a discharge-side slant portion is set in the range of 30 to 35 degrees.

4 Claims, 9 Drawing Sheets

AXIAL FLOW FAN

CROSS-REFERENCE TO RELATED APPLICATION

This application claims priority to Japanese Application No. 2012-196327, filed Sep. 6, 2012, the entirety of which is incorporated herein by reference.

BACKGROUND

1. Technical Field

The present invention relates to an axial flow fan in which the shape of a rotating blade of an impeller and the shape of an inner surface of a venturi casing surrounding an outer periphery of the impeller in a radial direction are optimized.

2. Description of Related Arts

An axial flow fan includes a cylinder-shaped venturi casing at an outer periphery of an impeller in a radial direction for forming an axial flow in conjunction with the impeller. The impeller is mounted on a rotating shaft of a rotary drive device. The axial flow fan is widely used as a cooling fan of a device such as a server because of its simple structure.

The axial flow fan typically has the blow characteristics in that air volume is large and a static pressure is small. To improve such blow characteristics of the axial flow fan, the shape of a rotating blade of the impeller and the structure of the venturi casing have been devised in various ways.

As a technology related to the shape of the rotating blade of the impeller, an axial flow fan is disclosed in which a line extending from a center of rotation of the impeller and passing an intersection of a trailing edge of a blade and a radially outer edge thereof is arranged closer to the side of a rotating direction, compared to another line extending from the center of rotation of the impeller and passing an intersection of a leading edge of the blade and a boundary between a hub and the blade. Furthermore, in this axial flow fan, a camber ratio from a radius of the hub to a radius of the radially outer edge of a blade, which is minimum at a joint with the hub across the blade, monotonically increases to be maximum at the radially outer edge of the blade (see Japanese Patent Application Laid-Open Publication No. 2008-111383, for example).

Further, as a technology related to the structure of a venturi casing, a blower device is disclosed in which a cross-sectional surface of an orifice (venturi casing) includes a partial or whole arc portion on a suction side, a linear portion, and a discharge-side arc portion, and in which the arc radius of the suction-side arc portion is formed larger than the arc radius of the discharge-side arc portion (see Japanese Patent Application Laid-Open Publication No. 5-133398, for example).

Incidentally, the axial flow fan in Japanese Patent Application Laid-Open Publication No. 2008-111383 achieves noise reduction by forming a flow parallel to the rotating shaft on a plane including the rotating shaft while maintaining static pressure by improving the shape of the rotating blade of the impeller.

On the other hand, the blower device in Japanese Patent Application Laid-Open Publication No. 5-133398 achieves noise reduction while obtaining a large air flow by forming the arc radius of the suction-side arc portion larger than the arc radius of the discharge-side arc portion.

However, operation characteristics of the axial flow fan are affected by interaction between the shape of the rotating blade of the impeller and the structure of the venturi casing.

Therefore, noise reduction and high static pressure may not be achieved in an actual use area even though only the shape of the rotating blade of the impeller or the structure of the venturi casing is set individually.

The present invention has been made in view of the foregoing circumstances, and an object of the present invention is to provide an axial flow fan capable of achieving noise reduction and high static pressure in the actual use area.

SUMMARY

To achieve the above-mentioned object, an axial flow fan includes an impeller and a venturi casing.

The impeller is mounted on a rotating shaft of a rotary drive device. The venturi casing surrounds an outer periphery of the impeller in a radial direction and includes a suction port and a discharge port facing each other in an axial direction of the rotating shaft.

A leading edge of a rotating blade of the impeller is formed in an arc which is recessed in a direction opposite to a rotating direction of the impeller. An angle where an extended line of the recessed arc of the leading edge meets another extended line of a curve of a side edge is set in an acute angle of 30 to 37 degrees in a front view so that a leading tip of the rotating blade may be projected in the rotating direction.

An opening angle θ3 of a suction-side slant portion in the venture casing is set in the range of 12 to 17 degrees, and an opening angle of a discharge-side slant portion in the venture casing is set in the range of 30 to 35 degrees.

In the axial flow fan according to an embodiment of the present invention, the leading edge of the rotating blade of the impeller is formed in an arc which is recessed in a direction opposite to the rotating direction of the impeller. The angle where the extended line of the recessed arc of the leading edge meets the other extended line of a curve of a side edge is set in an acute angle of 30 to 37 degrees in a front view so that the leading tip of the rotating blade may be projected in the rotating direction.

The opening angle θ3 of the suction-side slant portion in the venturi casing is set in the range of 12 to 17 degrees. The opening angle of the discharge-side slant portion in the venturi casing is set in the range of 30 to 35 degrees.

Therefore, the axial flow fan according to an embodiment of the present invention may achieve, in an actual use area, noise reduction and high static pressure by optimizing the shape of the rotating blade of the impeller and the shape of an inner surface of the venturi casing which surrounds an outer periphery of the impeller in a radial direction.

DETAILED DESCRIPTION

Hereinafter, an axial flow fan according to the present embodiment will be described with reference to the drawings.

The axial flow fan is a blower device that takes in air from one end in the axial direction of a rotating shaft and discharges fluid to the other end in the axial direction by rotating an impeller mounted on the rotating shaft of a rotary drive device. The axial flow fan according to the present embodiment may achieve noise reduction and high static pressure in an actual use area by improving the shape of a rotating blade of the impeller and the shape of an inner surface of a venturi casing which surrounds an outer periphery of the impeller in the radial direction.

[Structure of Axial Flow Fan]

Figure 1A:
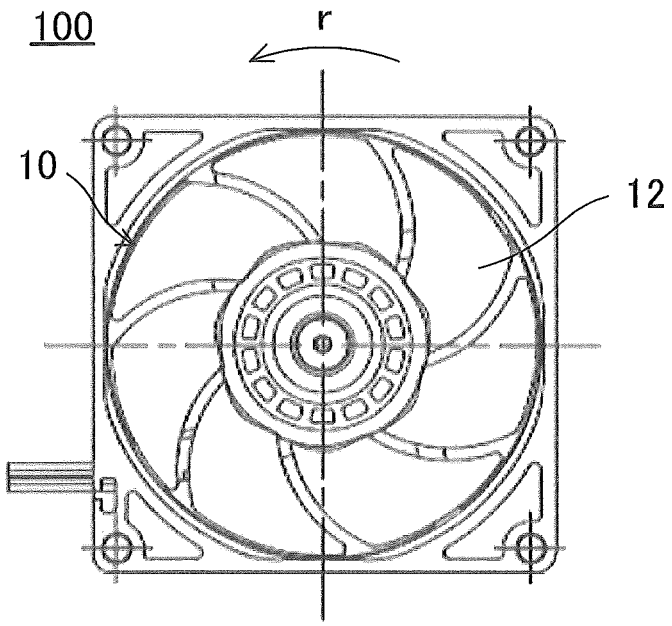
FIGS. 1A and 1B are respectively a front view and a back view of an axial flow fan according to the present embodiment.
Figure 1B:
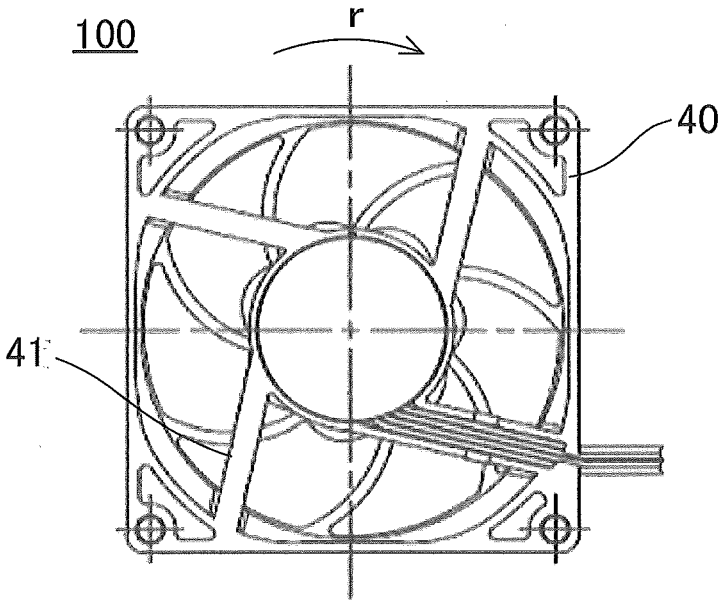
Figure 2A:
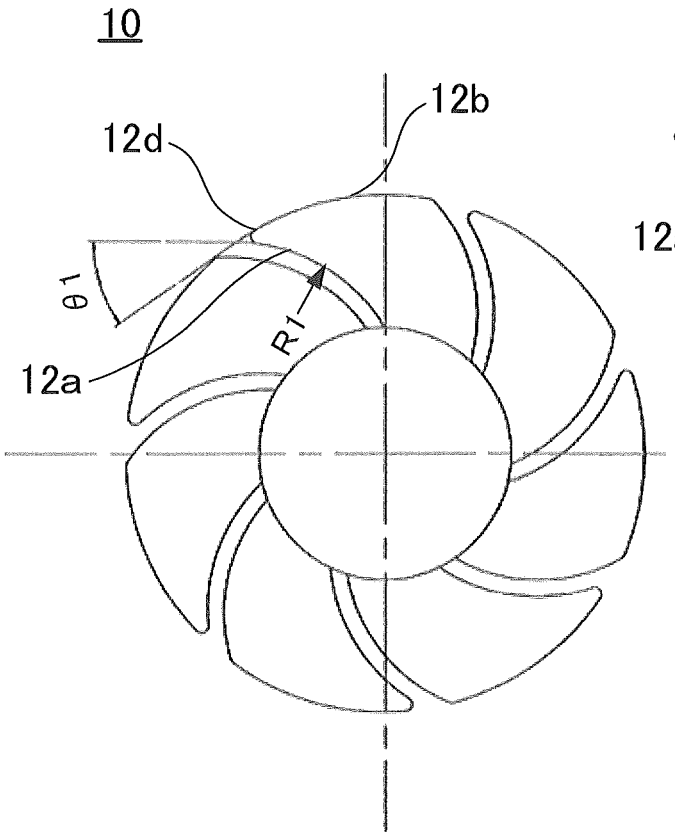
FIGS. 2A and 2B are respectively a front view and a sectional side view of an impeller according to the present embodiment.
Figure 2B:
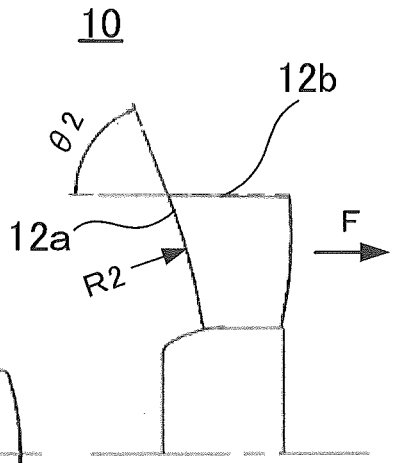
Figure 3:
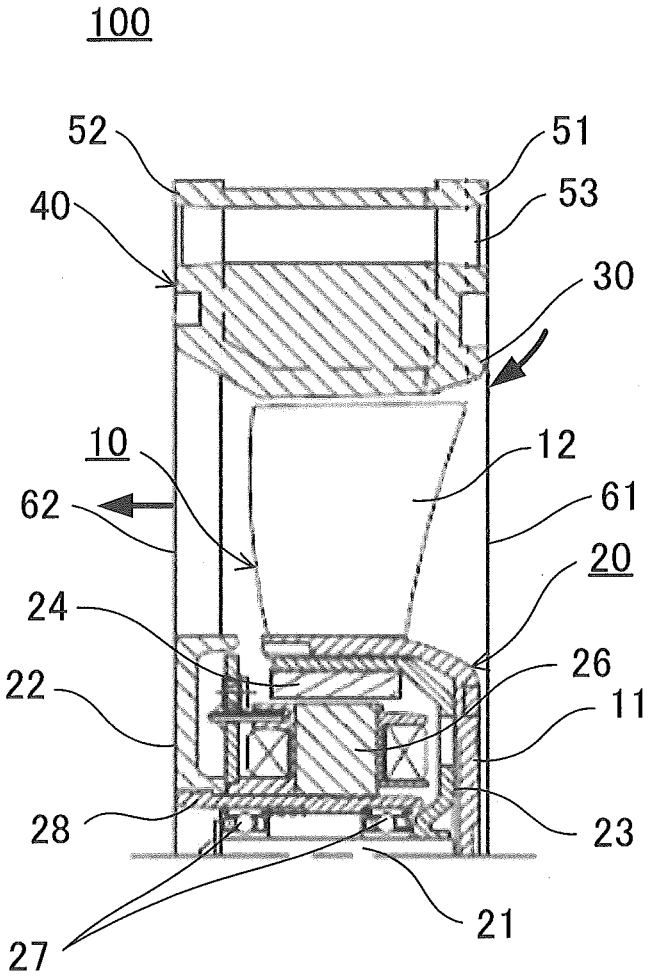
FIG. 3 is a sectional side view of the axial flow fan according to the present embodiment.
Figure 4A:
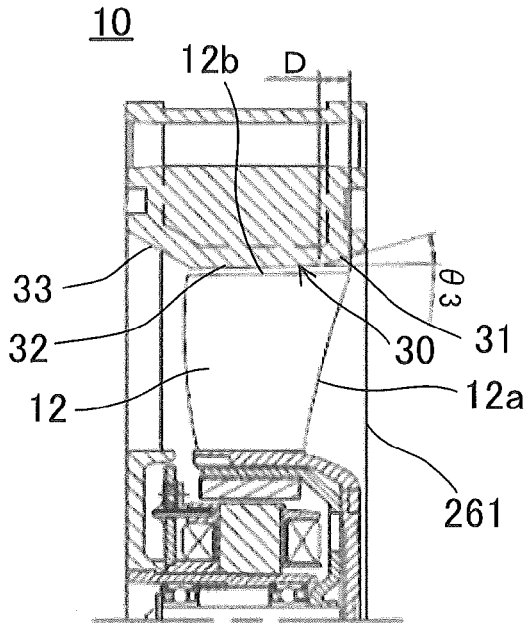
FIGS. 4A and 4B are views illustrating the structure of a venturi casing according to the present embodiment.
Figure 4B:
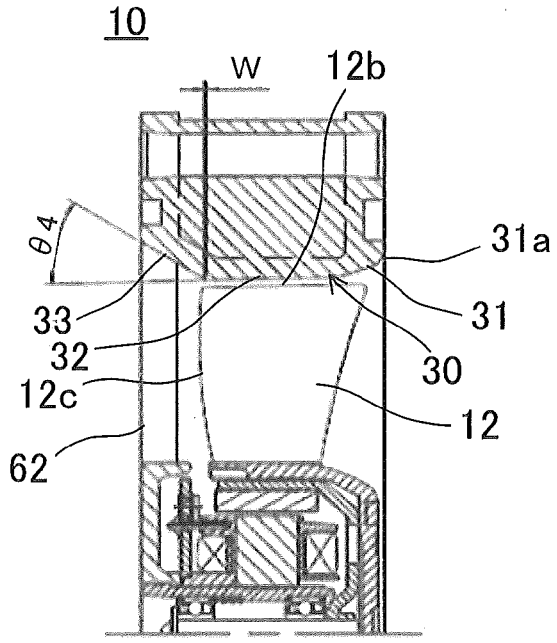

First, the configuration of the axial flow fan according to the present embodiment will be described with reference to FIGS. 1A, 1B, 2A, 2B, 3, 4A, and 4B. FIGS. 1A and 1B are respectively a front view and a back view of an axial flow fan according to the present embodiment. FIGS. 2A and 2B are respectively a front view and a sectional side view of an impeller according to the present embodiment. FIG. 3 is a sectional side view of the axial flow fan according to the present embodiment. FIGS. 4A and 4B are views illustrating the structure of a venturi casing according to the present embodiment.

The axial flow fan 100 according to the present embodiment includes, as illustrated in FIGS. 1A to 3, an impeller 10 mounted on a rotating shaft 21 of a rotary drive device 20, and a frame 40 which surrounds a periphery of the impeller 10. The frame 40 is formed integrally with a venturi casing (hereinafter, simply referred to as "casing") 30 which surrounds an outer periphery of the impeller 10 in the radial direction. Further, four stays 41 are provided on a discharge side of the frame 40 to support a base portion 22 of the rotary drive device 20.

The impeller 10 includes a cup-shaped hub portion 11 in the center thereof. A plurality of rotating blades 12 is integrally and radially mounted on a periphery of the hub portion 11. The impeller 10 of the axial flow fan 100 according to the present embodiment includes seven rotating blades 12. Each of the rotating blades 12 is provided while being slanted with respect to an axial direction of the rotating shaft 21.

Here, the shape of the rotating blade 12 of the impeller 10 according to the present embodiment will be described. The axial flow fan 100 according to the present embodiment has a first feature in the blade shape of the impeller 10.

In the front view of FIG. 2A, a leading edge 12*a* of the rotating blade 12 is formed to have an arc R1 recessed in a direction opposite to a rotating direction r of the impeller 10.

A leading tip 12*d* of the rotating blade 12 is projected in the rotating direction r. In the front view of FIG. 2A, an angle θ1, where an extended line of the recessed arc of the leading edge 12*a* meets another extended line of a curve of a side edge 12*b*, is preferably an acute angle of, for example, 30 to 37 degrees.

Further, in the sectional side view of FIG. 2B, the leading edge 12*a* of the rotating blade 12 is formed to be an arc R2 projected in a fluid discharge direction F. In the sectional side view of FIG. 2B, an angle θ2, where an extended line of the projected arc of the leading edge 12*a* meets an extended line of a curve of the blade side edge 12*b*, is preferably an acute angle of, for example, 65 to 70 degrees.

Referring back to FIG. 3, a motor as the rotary drive device 20 of the impeller 10 is provided inside the hub portion 11. The motor 20 includes an approximately cup-shaped rotor yoke 23, the rotating shaft 21 press-fitted into the central part of the rotor yoke 23, and a stator core 26 around which a coil 25 is wound.

The rotor yoke 23 is fitted into the hub portion 11. A magnet 24 is fixed on an inner peripheral surface of the rotor yoke 23.

The rotating shaft 21 is rotatably supported by a bearing 27. The bearing 27 is fixed to an inner surface of a cylinder-shaped support portion 28.

The stator core 26 is press-fitted onto an outer surface of the support portion 28. The stator core 26 and the magnet 24 of the rotor yoke 23 face each other with a gap therebetween.

Flange portions 51 and 52 for fixing the frame 40 to an electronic device and the like are provided at the rims on the suction side and the discharge side, respectively, of the casing 30. The respective flange portions 51 and 52 are extended outward in the radial direction of the impeller 10 from the suction side and the discharge side, respectively, of the casing 30. These flange portions 51 and 52 are square-shaped mounting members formed continuously to an outer peripheral wall of the casing 30. Screw holes 53, into which mounting screws are screwed, are formed at four corners of each of the flange portions 51 and 52.

The axial flow fan 100 is mounted to a housing, etc. of an electronic device and the like by screwing the mounting screw (not illustrated) into the screw hole 53.

Next, the shape of an inner surface of the casing 30 according to the present embodiment will be described. The axial flow fan 100 according to the present embodiment has a second feature in the shape of the inner surface of the casing 30.

As illustrated in FIG. 4, the inner surface of the casing 30 includes, from the suction side to the discharge side, a suction-side slant portion 31, a linear portion 32, and a discharge-side slant portion 33, and these portions sequentially continue in the order.

The suction-side slant portion 31 is a part which expands a suction port 61 outward in the radial direction of the impeller 10. The suction-side slant portion 31 according to the present embodiment linearly expands the suction port 61 outward in the radial direction of the impeller 10. An opening angle θ3 of the suction-side slant portion 31 is set small, for example, at an inclination angle of 12 to 17 degrees.

An edge portion 31*a* of the suction-side slant portion 31 is chamfered in an arc shape. By thus chamfering the edge portion 31*a* of the suction-side slant portion 31, it becomes possible to take in fluid around the suction port 61 so as to increase air flow rate of the axial flow fan 100.

Here, the air flow rate means the air volume which the axial flow fan 100 takes in and discharges per unit time. The larger the pressure ratio, the smaller the air flow rate on the discharge side due to compression. Therefore, typically, the air flow rate on the suction side is used.

The linear portion 32 is a part which continues from the suction-side slant portion 31 and connects the suction-side slant portion 31 to the discharge-side slant portion 33 with a straight line. Also, the linear portion 32 forms an axial flow of fluid together with the impeller 10. This linear portion 32 faces a side edge of the rotating blade 12 of the impeller 10 with a gap therebetween and extends toward the discharge side in substantially parallel to the side edge of the rotating blade 12.

A distance D from a boundary between the linear portion 32 and the suction-side slant portion 31 to an intersection of the leading edge 12*a* and the side edge 12*b* of the rotating blade 12 is set to, for example, approximately 3.0 to 3.5 mm.

The discharge-side slant portion 33 is a part which continues from the linear portion 32 and connects the linear portion 32 with a curved expanded portion 34. An opening angle θ4 of the discharge-side slant portion 33 is set small, for example, at an inclination angle of 30 to 35 degrees.

A distance W from a boundary between the linear portion 32 and the discharge-side slant portion 33 to an intersection of a trailing edge 12*c* and the side edge 12*b* of the rotating blade 12 is set to, for example, approximately 0.1 to 0.5 mm so that the boundary and the intersection are located in nearly the same position. Note that the boundary between the linear portion 32 and the discharge-side slant portion 33 is positioned closer to the suction side than the intersection of the trailing edge 12*c* and the side edge 12*b* of the rotating blade 12 is, so that the boundary is not positioned on the discharge side of the intersection.

[Effect of Axial Flow Fan]

Next, effects provided by the axial flow fan 100 according to the present embodiment will be described with reference to FIGS. 1A to 9.

The axial flow fan 100 according to the present embodiment is mounted to a housing or the like of an electronic device by screwing mounting screws (not illustrated) into the screw holes 53 of the flange portions 51 and 52 (refer to FIG. 3). For example, in the case of using the axial flow fan 100 as a cooling fan of a server, the axial flow fan 100 is mounted, with the side of the suction-side flange portion 51 abutting against a fan mounting area on an inner surface of the housing of the server.

The operation characteristics of the axial flow fan according to the present embodiment (product according to the present invention) will be described below, in comparison with the operation characteristics of prior axial flow fans (first and second products in the related art).

<Product According to Present Invention>

In the axial flow fan 100 as the product according to the present invention, the impeller 10 includes the seven rotating blades 12 (refer to FIG. 1A). The arc R1 of the leading edge 12*a* of the rotating blade 12 in the front view of FIG. 2A is set to an arc of R25 and the arc R2 in the sectional side view of FIG. 2B is set to an arc of R90.

In the front view of FIG. 2A, the angle θ1, where the extended line of the recessed arc of the leading edge 12*a* meets another extended line of a curve of the side edge 12*b*, is set to 36 degrees. In the sectional side view of FIG. 2B, the angle θ2, where the extended line of the recessed arc of the leading edge 12*a* meets the other extended line of the curve of the side edge 12*b*, is set to 69 degrees.

In the axial flow fan 100, the four stays 41 are formed on the discharge side of the frame 40 (refer to FIG. 1B).

The inner surface of the casing 30 in the axial flow fan 100 as the product according to the present invention includes, from the suction side to the discharge side, the suction-side slant portion 31, the linear portion 32, and the discharge-side slant portion 33, and these portions sequentially continue in the order (refer to FIGS. 4A and 4B).

As illustrated in FIG. 4A, the suction-side slant portion 31 linearly expands the suction port 61 outward in the radial direction of the impeller 10. The opening angle θ3 of the suction-side slant portion 31 is set to 15 degrees.

The distance D from the boundary between the linear portion 32 and suction-side slant portion 31 to the intersection of the leading edge 12*a* and the side edge 12*b* of the rotating blade 12 is set to 3.3 mm.

As illustrated in FIG. 4B, the discharge-side slant portion 33 linearly expands the discharge port 62 outward in the radial direction of the impeller 10. The opening angle θ4 of the discharge-side slant portion 33 is set to 32 degrees.

The distance W from the boundary between the linear portion 32 and the discharge-side slant portion 33 to the intersection of the trailing edge 12*c* and the side edge 12*b* of the rotating blade 12 is set to 0.3 mm so that the boundary and the intersection are located in nearly the same position.

<First Product in Related Art>

Figure 5A:
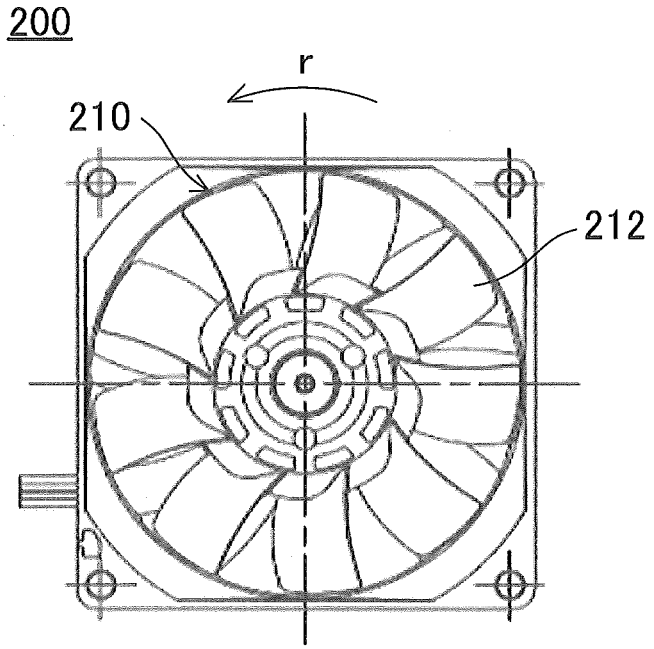
FIGS. 5A and 5B are respectively a front view and a back view of an axial flow fan according to a first comparative embodiment.
Figure 5B:
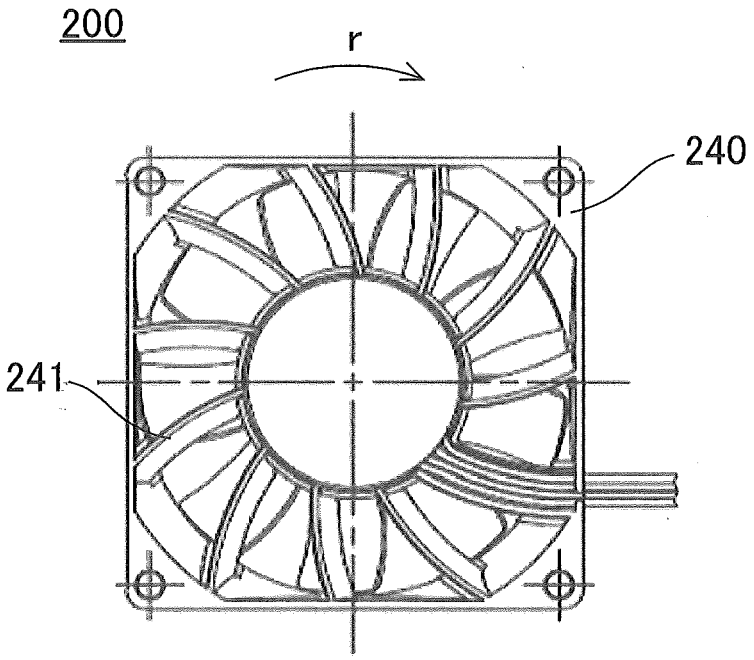
Figure 6A:
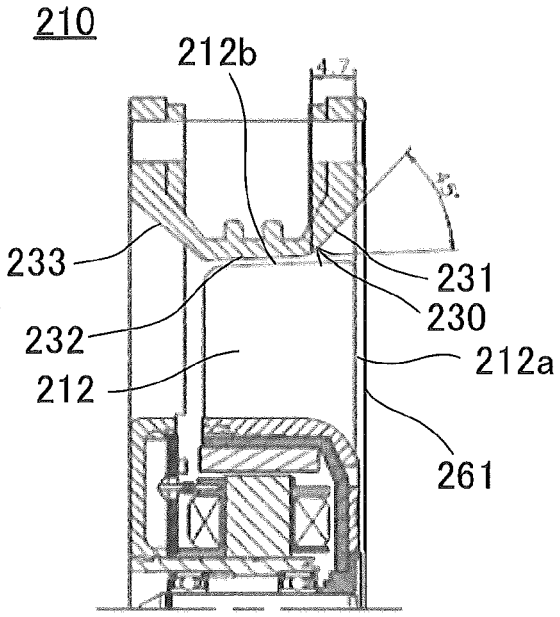
FIGS. 6A and 6B are views illustrating the structure of a venturi casing according to the first comparative embodiment.
Figure 6B:
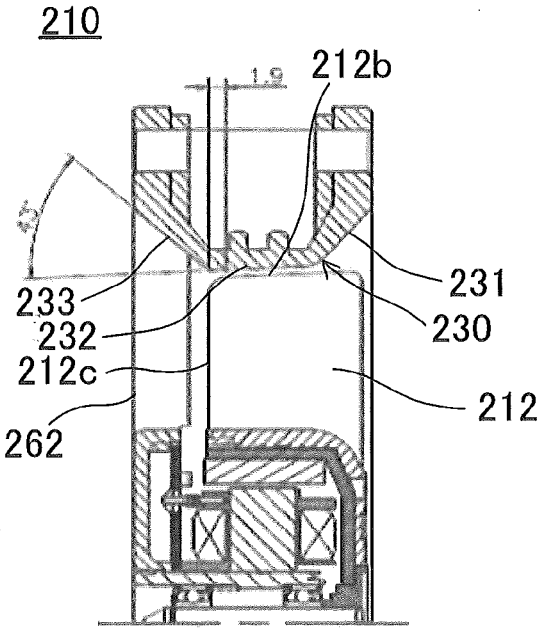

First, an axial flow fan 200 as a first product in the related art will be described with reference to FIGS. 5A to 6B. FIGS. 5A and 5B are respectively a front view and a back view of the axial flow fan as the first product in the related art. FIGS. 6A and 6B are views illustrating the structure of a venturi casing of the first product in the related art.

The axial flow fan 200 as the first product in the related art is an axial flow fan of SANYO DENKI CO., LTD., model No. 9GV0812P4K03.

As illustrated in FIG. 5A, an impeller 210 of the axial flow fan 200 includes nine rotating blades 212. The rotating blades 212 of the axial flow fan 200 are sweptback blades.

As illustrated in FIG. 5B, eleven stator blades 241 are formed on a discharge side of a frame 240 of the axial flow fan 200.

As illustrated in FIGS. 6A and 6B, an inner surface of a casing 230 of the axial flow fan 200 includes, from the suction side to the discharge side, a suction-side slant portion 231, a linear portion 232, and a discharge-side slant portion 233, and these portions sequentially continue in the order.

As illustrated in FIG. 6A, the suction-side slant portion 231 linearly expands a suction port 261 outward in the radial direction of the impeller 210. An opening angle of the suction-side slant portion 231 is set large, for example, at an inclination angle of 45 degrees.

A distance from a boundary between the linear portion 232 and the suction-side slant portion 231 to an intersection of a leading edge 212*a* and a side edge 212*b* of the rotating blade 212 is set to 4.7 mm.

As illustrated in FIG. 6B, the discharge-side slant portion 233 linearly expands a discharge port 262 outward in the radial direction of the impeller 210. An opening angle of the discharge-side slant portion 233 is set large, for example, at an inclination angle of 43 degrees.

A distance from a boundary between the linear portion 232 and the discharge-side slant portion 233 to an intersection of a trailing edge 212*c* and the side edge 212*b* of the rotating blade 212 is set to 1.9 mm.

<Second Product in Related Art>

Figure 7A:
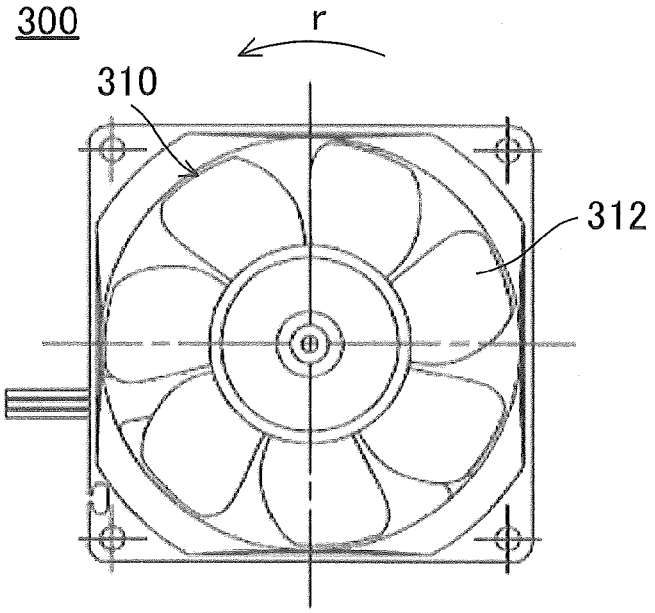
FIGS. 7A and 7B are respectively a front view and a back view of an axial flow fan according to a second comparative embodiment.
Figure 7B:
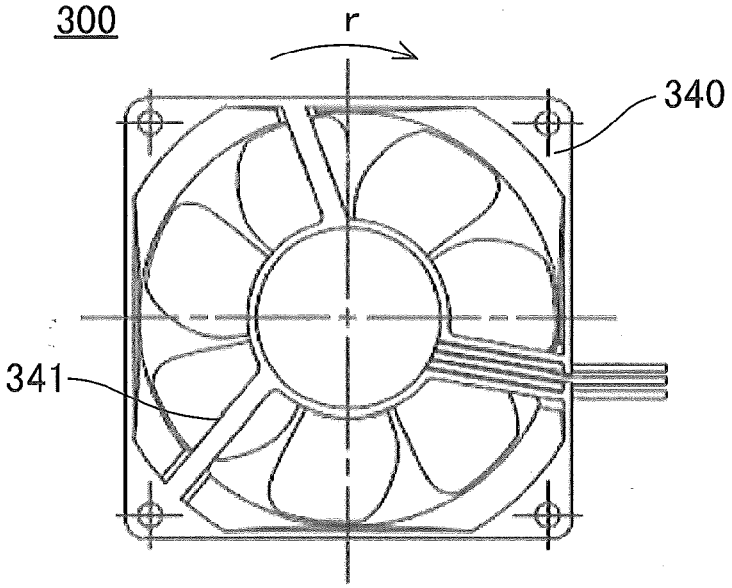
Figure 8A:
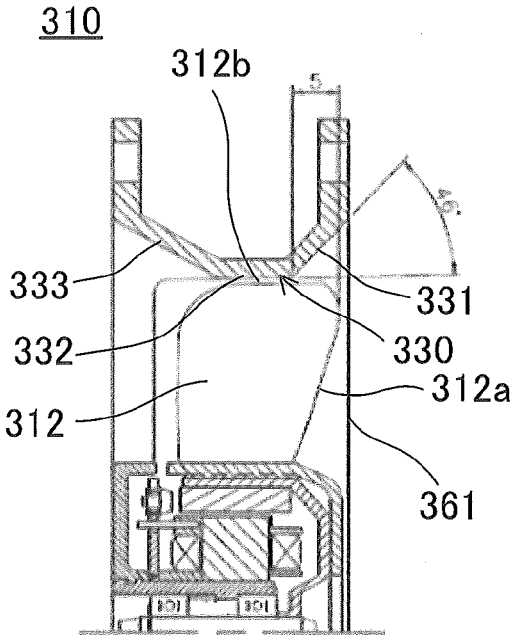
FIGS. 8A and 8B are views illustrating the structure of a venturi casing according to the second comparative embodiment.
Figure 8B:
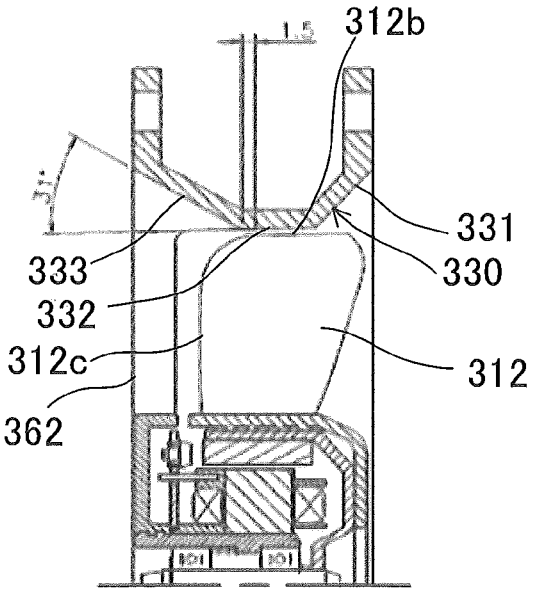

First, an axial flow fan 300 as a second product in the related art will be described with reference to FIGS. 7A to 8B. FIGS. 7A and 7B are respectively a front view and a back view of the axial flow fan as the second product in the related art. FIGS. 8A and 8B are views illustrating the structure of a venturi casing of the second product in the related art.

The axial flow fan 300 as the second product in the related art is an axial flow fan of SANYO DENKI CO., LTD., model No. 109R0812G401.

As illustrated in FIG. 7A, an impeller 310 of the axial flow fan 300 includes seven rotating blades 312. The rotating blade 312 of the axial flow fan 300 has a large-angled blade tip, and a leading edge of the rotating blade is formed not in an arc but in a straight line.

As illustrated in FIG. 7B, three stays 341 are formed on a discharge side of a frame 340 of the axial flow fan 300.

As illustrated in FIGS. 8A and 8B, an inner surface of a casing 330 of the axial flow fan 300 includes, from the suction side to the discharge side, a suction-side slant portion 331, a linear portion 332, and a discharge-side slant portion 333, and these portions sequentially continue in the order.

As illustrated in FIG. 8A, the suction-side slant portion 331 linearly expands a suction port 361 outward in the radial direction of the impeller 310. An opening angle of the suction-side slant portion 331 is set large, for example, at an inclination angle of 45 degrees.

A distance from a boundary between the linear portion 332 and the suction-side slant portion 331 to an intersection of a leading edge 312*a* and a side edge 312*b* of the rotating blade 312 is set to 5.0 mm.

As illustrated in FIG. 8B, the discharge-side slant portion 333 linearly expands a discharge port 362 outward in the radial direction of the impeller 310. An opening angle of the discharge-side slant portion 333 is set large; for example, at an inclination angle of 31 degrees.

A distance from a boundary between the linear portion 332 and the discharge-side slant portion 333 to an intersection of a trailing edge 312*c* and the side edge 312*b* of the rotating blade 312 is set to 1.5 mm.

<Comparison of Operation Characteristics Between Product According to Present Invention and Products in Related Art>

Figure 9:
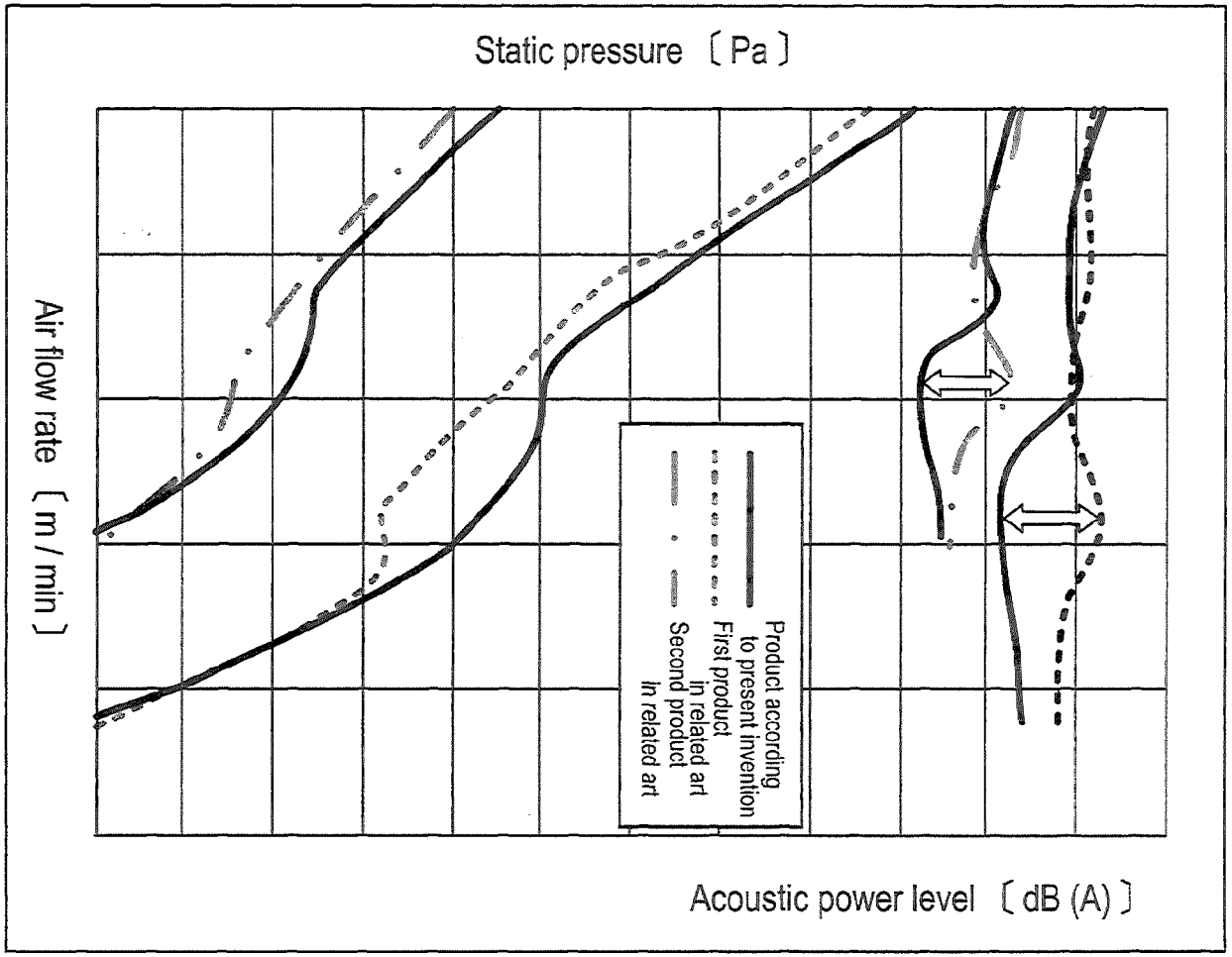
FIG. 9 is a graph illustrating comparison results of noise characteristics and air flow rate-static pressure characteristics between a product according to the present invention and products in the related art.

FIG. 9 is a graph illustrating comparison results of noise characteristics and air flow rate-static pressure characteristics between the product according to the present invention and the first and second products in the related art.

In the comparison between the product according to the present invention and the first and second products in the related art, the rotation speed was set so that maximum air flow rates of the axial flow fans to be compared may become approximately the same.

In FIG. 9, looking at curves of acoustic power level, it is shown that noise is reduced in the product according to the present invention, because the acoustic power level of the product according to the present invention has more regions of low acoustic power level than the first and second products in the related art. That is, the product according to the present invention is superior in noise reduction in an actual use area.

Next, looking at curves of the air flow rate-static pressure characteristics in FIG. 9, it is shown that high static pressure is maintained in the product according to the present invention, because the air flow rate-static pressure characteristics of the product according to the present invention have higher inflection points than the first and second products in the related art.

According to the axial flow fan 100 of the present embodiment, the leading edge 12*a* of the rotating blade 12 of the impeller 10 is formed in an arc recessed in a direction opposite to the rotating direction r of the impeller 10. The angle where the extended line of the recessed arc of the leading edge meets the other extended line of the curve of the side edge is set in an acute angle of 30 to 37 degrees so that the leading tip 12*d* of the rotating blade 12 may be projected in the rotating direction r.

Specifically, the axial flow fan 100 according to the present embodiment is capable of delaying air flow separation even under a heavily-loaded condition by projecting the leading tip 12*d* in the rotating direction r and forming the leading edge 12*a* in an arc appropriately recessed, whereby noise reduction is achieved and the inflection points may be kept on the high static pressure side.

Further, the opening angle θ3 of the suction-side slant portion 31 in the venturi casing 30 is set in the range of 12 to 17 degrees. That is, the axial flow fan 100 according to the present embodiment is capable of reducing noise in a high air flow rate area, as in the arc suction shape, by adequately decreasing the opening angle θ3 of the suction-side slant portion 31. In the vicinity of the inflection points, air flow may be gradually separated, and therefore the decrease in static pressure is prevented at the inflection points.

Further, the opening angle θ4 of the discharge-side slant portion 33 in the venturi casing 30 is set in the range of 30 to 35 degrees. By setting the opening angle θ4 of the discharge-side slant portion 33 adequately small, the axial flow fan of the present embodiment can suppress occurrence of turbulent air flow in a high air flow rate area and achieve a high air flow rate at the same rotation speed. As a result, the rotation speed may be slowed down at the same flow rate, and further noise reduction may be achieved.

Therefore, the axial flow fan 100 according to the present invention achieves, in the actual use area, noise reduction and high static pressure by optimizing the shape of the rotating blade 12 and the shape of the inner surface of the venturi casing 30 which surrounds the outer periphery of the impeller 10 in the radial direction.

The preferred embodiment of the present invention has been described above, but the embodiment is merely an example for describing the present invention, and it is not intended to limit the scope of the present invention only to the above embodiment. The present invention may be implemented in various aspects different from the above-described embodiment without departing from the gist of the present invention.

What is claimed is:

1. An axial flow fan, comprising:

an impeller mounted on a rotating shaft of a rotary drive device; and a venturi casing surrounding an outer periphery of the impeller in a radial direction and including a suction port and a discharge port which face each other in an axial direction of the rotating shaft, wherein a leading edge of a rotating blade of the impeller is formed in an arc recessed in a direction opposite to a rotating direction of the impeller, and an angle where an extended line of the recessed arc of the leading edge meets another extended line of a curve of a side edge is set in an acute angle of 30 to 37 degrees in a front view such that a leading tip of the rotating blade is projected in the rotating direction, and an opening angle of a suction-side slant portion of the venturi casing relative to a longitudinal axis of the venturi casing is set in a range of 12 to 17 degrees and an opening angle of a discharge-side slant portion of the venturi casing relative to the longitudinal axis of the venturi casing is set in a range of 30 to 35 degrees.

2. The axial flow fan according to claim 1, wherein a distance from a boundary between a linear portion and the discharge-side slant portion of the venturi casing to an intersection of a trailing edge and the side edge of the rotating blade is set to approximately 0.1 to 0.5 mm such that the boundary and the intersection are located in nearly the same position.

3. The axial flow fan according to claim 1, wherein a boundary between a linear portion and the discharge-side slant portion of the venturi casing is positioned closer to a suction side than an intersection of a trailing edge and the side edge of the rotating blade is.

4. The axial flow fan according to claim 1, wherein a distance from a boundary between a linear portion and the suction-side slant portion of the venturi casing to an intersection of the leading edge and the side edge of the rotating blade is set to approximately 3.0 to 3.5 mm.

* * * * *